US005649817A

United States Patent [19]

Yamazaki

[11] Patent Number: 5,649,817

[45] Date of Patent: Jul. 22, 1997

[54] SCROLL TYPE FLUID MACHINE HAVING FIRST AND SECOND BEARINGS FOR THE DRIVING SHAFT

[75] Inventor: Seiichi Yamazaki, Nabari, Japan

[73] Assignee: Kabushiki Kaisha Yasunaga, Ueno, Japan

[21] Appl. No.: 656,837

[22] Filed: Jun. 3, 1996

[30] Foreign Application Priority Data

Nov. 24, 1995 [JP] Japan ..... 7-344676

[51] Int. Cl.[6] ..... F01C 1/04; F01C 21/02

[52] U.S. Cl. ..... 418/55.1; 418/55.2; 418/151

[58] Field of Search ..... 418/55.1, 55.2, 418/55.3, 151

[56] References Cited

U.S. PATENT DOCUMENTS

| | | | |
|---|---|---|---|
| 3,874,827 | 4/1975 | Young | 418/57 |
| 4,065,279 | 12/1977 | McCullough | 418/55.6 |
| 4,466,784 | 8/1984 | Hiraga | 418/55.1 |
| 4,475,875 | 10/1984 | Sugimoto et al. | 418/55.1 |
| 4,551,081 | 11/1985 | Sato et al. | 418/55.1 |
| 4,558,997 | 12/1985 | Sakata et al. | 418/55.2 |
| 5,033,945 | 7/1991 | Kolb | 418/55.1 |
| 5,466,134 | 11/1995 | Shaffer et al. | 418/55.3 |

FOREIGN PATENT DOCUMENTS

| | | | |
|---|---|---|---|
| 1-12953 | 3/1989 | Japan . | |
| 2277985 | 11/1990 | Japan | 418/55.1 |
| 4-314985 | 11/1992 | Japan . | |

*Primary Examiner*—John J. Vrablik

*Attorney, Agent, or Firm*—Birch, Stewart, Kolasch & Birch, LLP

[57] ABSTRACT

An oil-free type fluid machine with scrolls is disclosed, which contains a fixed scroll composed of a fixed scroll swirl, a fixed scroll base and a casing, an orbiting scroll composed of an orbiting scroll swirl, an orbiting scroll base and an orbiting scroll boss, the fixed scroll and the orbiting scroll interposed one another, a driving shaft, an eccentric driving shaft provided on the driving shaft with a predetermined eccentricity S, which penetrates the orbiting scroll boss and the fixed scroll base, the orbiting scroll performs an orbiting motion as opposed to the fixed scroll to form a compression room by the orbiting scroll and the fixed scroll, a member for preventing the orbiting scroll from rotating on the driving shaft, a first bearing for supporting the driving shaft, a second bearing for supporting the eccentric driving shaft at an end which is not adjacent to the driving shaft, a bearing shoe concentrically provided with respect to the driving shaft, around the eccentric driving shaft and inside the second bearing for obtaining a bilateral bearing structure, a shim provided on an end face of the first bearing, and a wave washer provided at an end face of the second bearing, the shim and the wave washer provided for appropriately adjusting and maintaining spaces formed by the fixed scroll and the orbiting scroll in the thrust direction.

6 Claims, 5 Drawing Sheets

SCROLL TYPE FLUID MACHINE HAVING FIRST AND SECOND BEARINGS FOR THE DRIVING SHAFT

BACKGROUND OF THE INVENTION

1. Field of the Invention

The present invention relates to a fluid machine with scrolls, which is effectively employed in particular as an air-compressor under a low or medium pressure.

2. Discussion of Background

In recent years, fluid machines with scrolls have utilized in many industrial fields accompanied with the growth of the finishing machines, since scroll mechanisms have excellent characteristics in compression such as a small torque fluctuation and noises. However, fluid machines of low contents are mainly on the market, and there are processing problems on scrolls for manufacturing large machines, more specifically it is difficult to maintain the accuracy of scrolls.

In order to prepare fluid machines with scrolls which give large discharges, it is necessary to increase the widths of scrolls and eccentricities thereof. In addition to the above, in the case of fluid machines with scrolls which are driven at high speeds to be manufactured, it is necessary to completely keep its dynamic balance, and to reduce the generation of a shake and noises.

FIG. 6 shows a conventional fluid machine with scrolls. The conventional fluid machine has the shortcomings that it is not impossible to increase the scroll width H nor the eccentricity S thereof since a satisfactory orbiting accuracy cannot be obtained by the machine in which the radial load applied to the scrolls is received by a single side bearing.

A orbiting scroll 4 is supported by an eccentric driving shaft **5*b* by way of a bearing 9, and performs an orbiting motion as opposed to a fixed scroll 3. The centrifugal force F works on the orbiting scroll 4 at the center of gravity thereof when the scroll 4 orbits. Therefore, the centrifugal force F changes its direction as the result of the orbiting motion, thereby causing a shake. In the case where the center of gravity of the orbiting scroll to which centrifugal force is applied is not on the center line of the eccentric driving shaft 5*b*** in the thrust direction thereof, it becomes extremely difficult to keep balance, since the centrifugal force F changes its size as the result from the orbiting motion. In addition, if the eccentricity S and/or the scroll width H are increased, the centrifugal force F becomes much larger, whereby an excessive shake is to be caused.

SUMMARY OF THE INVENTION

It is therefore an object of the present invention to provide an oil-free type fluid machine with scrolls without the above-mentioned drawbacks, which can obtain a stable performance and a large volume of fluid discharge with accurately regulating and maintaining spaces formed by a fixed and orbiting scrolls in the thrust direction.

The above object of the present invention can be achieved by an oil-free type fluid machine with scrolls comprising a fixed scroll comprising a fixed scroll swirl, a fixed scroll base and a casing, an orbiting scroll comprising an orbiting scroll swirl, an orbiting scroll base and an orbiting scroll boss, the fixed scroll and the orbiting scroll interposed one another, a driving shaft, an eccentric driving shaft provided on the driving shaft with a predetermined eccentricity S, which penetrates the orbiting scroll boss and the fixed scroll base, the orbiting scroll performs an orbiting motion as opposed to the fixed scroll to form a compression room between the orbiting scroll and the fixed scroll, means for preventing the orbiting scroll from rotating on the driving shaft, a first bearing for supporting the driving shaft, a second bearing for supporting the eccentric driving shaft at an end which is not adjacent to the driving shaft, a bearing shoe concentrically provided with respect to the driving shaft, around the eccentric driving shaft and inside the second bearing for obtaining a bilateral bearing structure, a shim provided on an end face of the first bearing, and a wave washer provided at an end face of the second bearing, the shim and the wave washer provided for appropriately adjusting and maintaining spaces formed by the fixed scroll and the orbiting scroll in the thrust direction.

BRIEF EXPLANATION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The present invention will be explained in detail with referring to figures.

Figure 1:
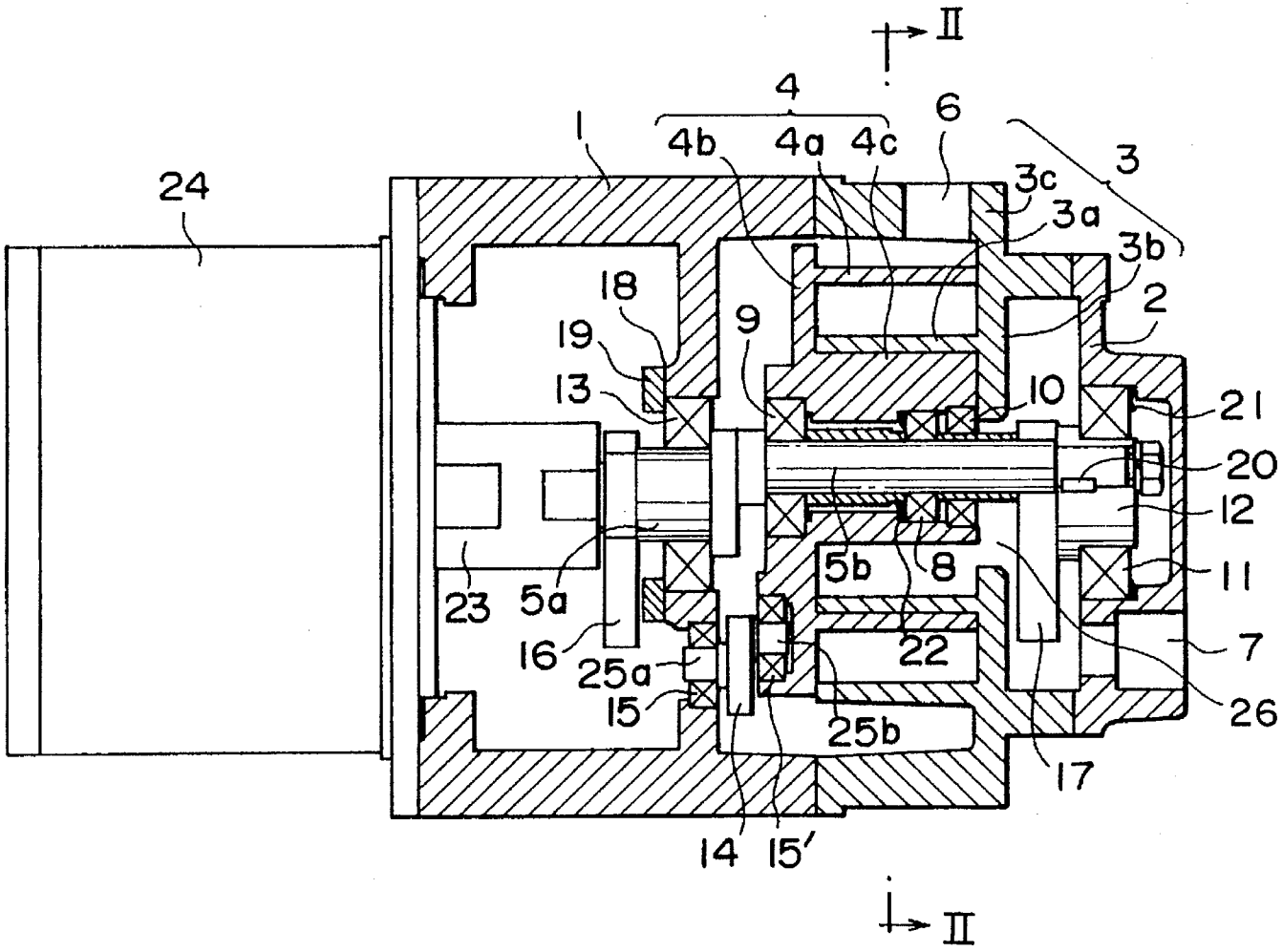
FIG. 1 is a vertical cross-sectional view of an embodiment of a fluid machine with scrolls according to the present invention.

An embodiment of the fluid machine with scrolls of the present invention is shown in FIG. 1 as a vertical cross-sectional view. FIG. 1 is an air-compressor directly coupled to a motor 24, as an embodiment of the present invention, in which power of the motor 24 is conveyed to a driving shaft **5*a* by means of a coupling 23. More specifically, a fixed scroll 3 is composed of a fixed scroll swirl 3*a*, a fixed scroll base 3*b* and a casing 3*c* with an intake 6 forming an united body, supported by a frame 1 fixed by means of fixing bolts. An orbiting scroll 4 is composed of an orbiting scroll swirl 4*a*, an orbiting scroll base 4*b* and an orbiting scroll boss 4*c* formed as an united body. The orbiting scroll swirl 4*a* and the fixed scroll swirl 3*a* are interposed one another, and a closed space is formed by them. The orbiting scroll base 4*b* and the boss 4*c* are supported as freely rotates on an eccentric driving shaft 5*b* which is eccentrically provided with a predetermined eccentricity with respect to a driving shaft 5*a* by way of bearings 8 and 9. The fluid introduced to the closed space through intake 6 is compressed because of the orbiting motion of the orbiting scroll as opposed to the fixed scroll and exits through discharge port 26 in fixed scroll base 3*b* and outlet 7. Furthermore, a seal 10 is provided on the orbiting scroll boss 4*c* at an outlet 7** side thereof to prevent air leakage.

The driving shaft **5*a* is supported by a frame 1 via a bearing 13 as can freely make an orbiting motion. An end face of the bearing 13 is fixed by a bearing cap 19 via a shim 18 for delicately adjusting the space formed by the orbiting and fixed scrolls in the thrust direction. The eccentric driving shaft 5b extends penetrating the orbiting scroll boss 4c and the fixed scroll base 3b. A bearing shoe 12 with a bearing 11 therearound is fixed thereto by use of a key 20, and positioned so as to be concentric with respect to the driving shaft 5a by being fixed and supported by means of a fixing nut. Moreover, the bearing shoe 12 is supported by a side cover 2 via the bearing 11. The side cover 2 is fixed to the casing 3c being supported by the same. Thus, a fluid machine with a complete bilateral bearing structure can be obtained, which can be designed to have a large capacity. In addition, wave washers 21 and 22 are inserted to end faces of the bearings 11 and 8**, to uniformly maintain the space in the thrust direction with the application of appropriate amount of pressure in a predetermined direction.

In the present invention, means is provided, which is for preventing the orbiting scroll 4 from rotating on the eccentric driving shaft 5b. In this embodiment, there are provided a supplemental shaft 25a which is supported by the frame 1 as freely rotates by way of a bearing 15, and a supplemental eccentric shaft 25b supported by the orbiting scroll base 4c also as can freely rotate via a bearing 15'. The shafts 25a and 25b are linked by means of a crank pin 14 with the same eccentricity as that made by the driving shaft 5a and eccentric driving shaft 5b.

Accordingly, the orbiting motion can be performed without the rotation of the orbiting scroll on the eccentric driving shaft nor making a shake by the provision of a plurality of sets of the above-mentioned means.

Figure 2:
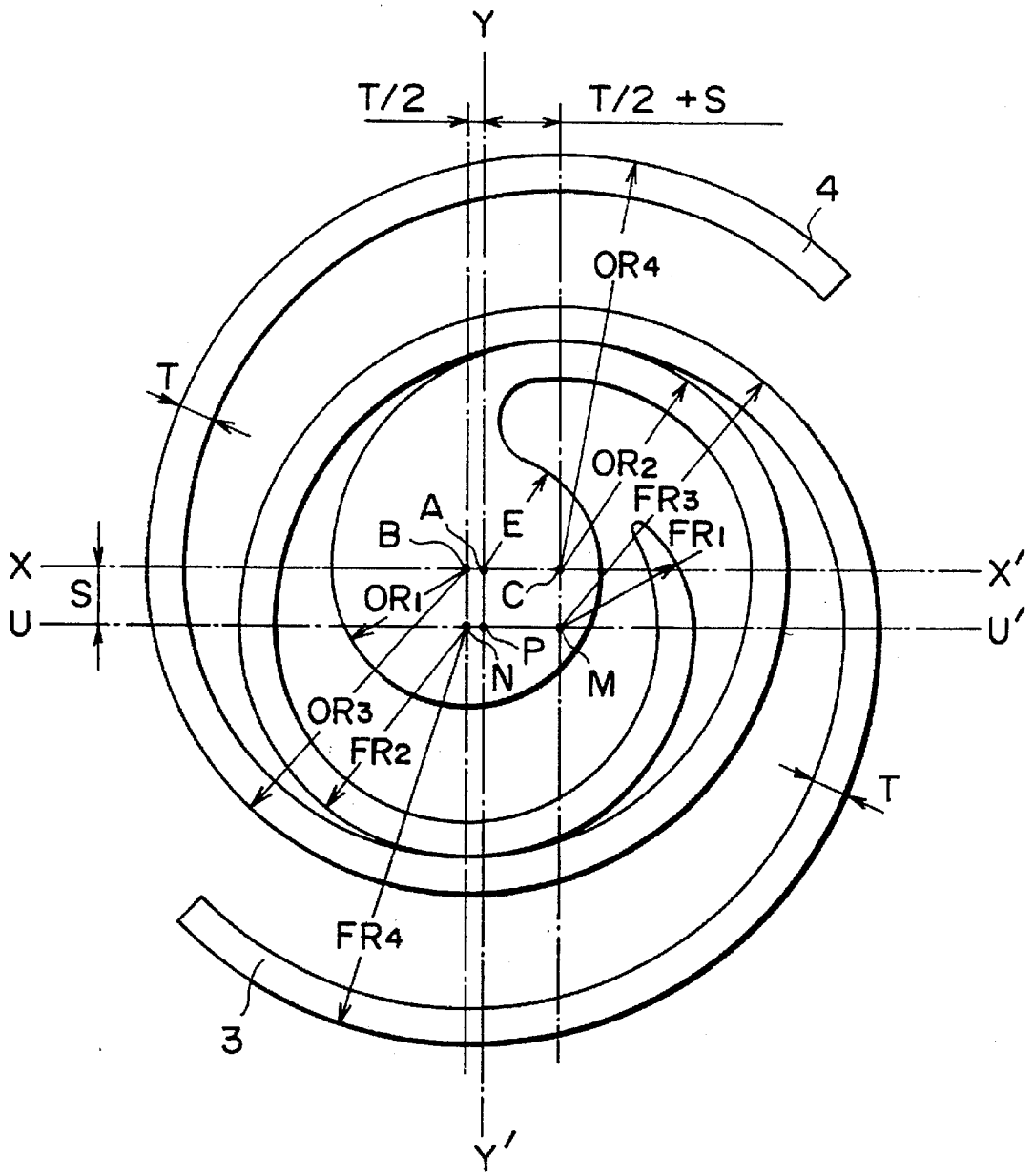
FIG. 2 is a diagram for explaining scrolls for use in the present invention.

The structure of the scrolls is explained with referring to FIG. 2. FIG. 2 is a schematic view of scrolls, seen from the right side of the machine by cutting along the line II—II in FIG. 1.

The outline of the orbiting scroll 4 with a width of T, comprising an orbiting scroll boss 4c is traced from the boss thereof as follows. Here, the eccentricity of the driving shaft is referred to as S.

First, an optional radius E is determined, started from a point A which corresponds to the center of the eccentric driving shaft 5b and is an intersection of base lines X–X' and Y–Y' which cross at right angles. An arc with the radius E is described around the point A, for instance started from a part which is above the line X–X' and right side of the line Y–Y', to a point on the line X–X' as shown in FIG. 2.

Subsequently, a half circle is drawn from the end of the arc thus obtained, with a center of the half circle determined as a point B which has a distance of T/2 to the left side of the point A and with a radius of $OR_1$=E+T/2.

Then, arcs of half circle, each connected to next arc on the line X–X' are successively traced respectively with radius of $OR_2$=$OR_1$+S+T, $OR_3$=$OR_2$+S+T, and $OR_4$=$OR_3$+S+T, and respectively drawn with centers C, B and C, C being determined as a point on the line X–X' apart from the point A by T/2+S.

On the other hand, the configuration of the fixed scroll is determined based on a base line Y–Y', and a base line U–U' drawn in parallel with the line X–X' at a lower side thereof by a length S, that is, the eccentricity. In FIG. 2, a point P, the intersection of the lines Y–Y' and U–U', corresponds to the center of the driving shaft 5a.

The shape of the fixed scroll 3 is outlined from the inner end thereof based on a point M on the line U U' which is apart from the point P by T/2+S, started from an appropriate part, for instance a slightly upper part of the line X–X' onto the line U–U'. The arcs of half circles, similarly to those of the orbiting scroll, are successively traced respectively with radius of $FR_1$.=E+T/2, $FR_2$=$FR_1$+S+T, $FR_3$=$FR_2$+S+T, and $FR_4$=$FR_3$+S+T, and respectively drawn with centers M, N, M, and N. In this case, N is determined as a point on the line U–U' apart from the point P by T/2 to the left side.

Thus, orbiting and fixed scroll swirls 4a and 3a are formed.

By the orbiting motion with the eccentricity of S of the orbiting scroll 4 based upon the supporting point of P with the eccentricity of S, the fluid in the closed space is compressed from the circumference toward the center, so that compressed fluid can be obtained.

Figure 3:
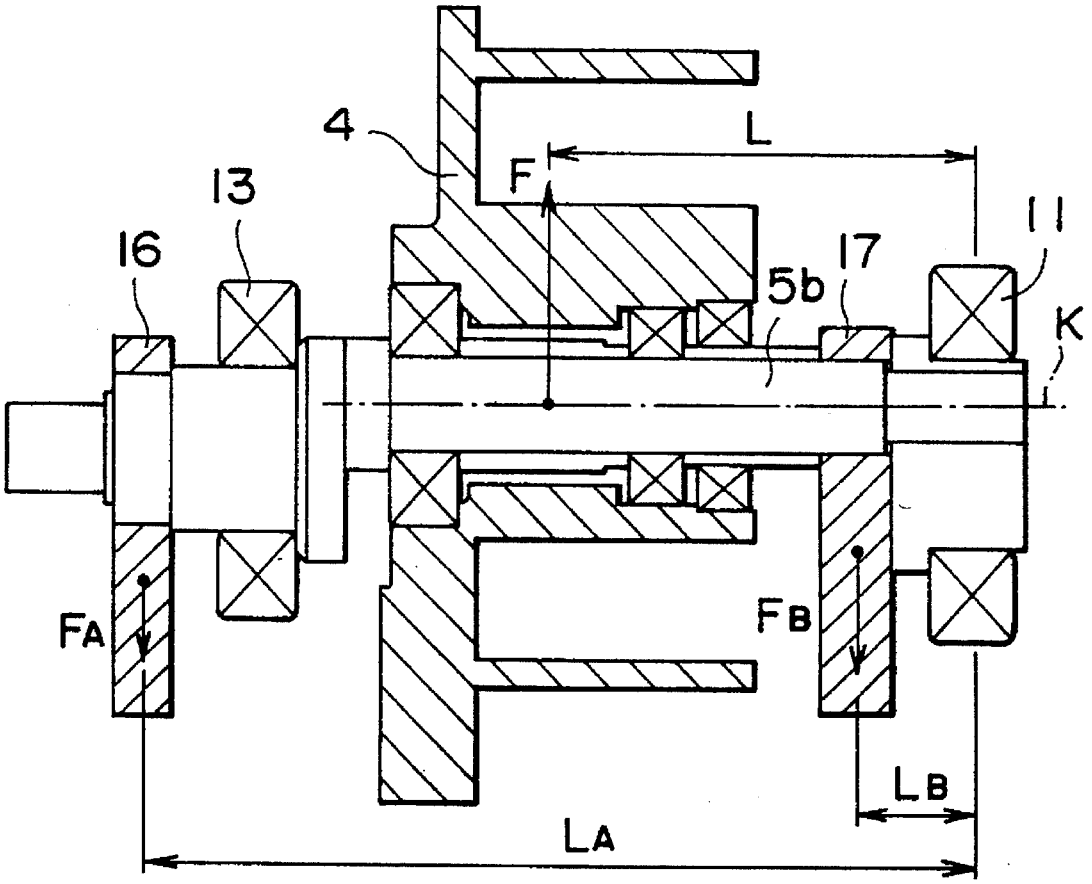
FIG. 3 is a partial vertical cross-sectional view of a fluid machine for explaining moment which works on each bearing.

With reference to a partial cross-sectional view of a fluid machine in FIG. 3, the moment applied to the bearing at the right side thereof will be now examined below.

The moment generated by the orbiting motion of the orbiting scroll 4 is determined as:

Centrifugal Force F×Distance L.

In order to eliminate this moment, the left and right balance weights 16 and 17 are provided.

Here, the following equation is established:

$$F \cdot L - F_A \cdot L_A - F_B \cdot L_B = 0$$

wherein $F_A$ represents the centrifugal force of the left balance weight 16; $L_A$, the distance between the point of application of centrifugal force and the bearing 11; $F_B$, the centrifugal force of the right balance weight 17; and $L_B$, the distance between the point of application of centrifugal force and the bearing 11.

This equation, however, is not satisfied in the case where the center of gravity of the orbiting scroll 4 is not positioned on the center line K of the eccentric driving shaft 5b, giving undetermined F values, as mentioned previously. Therefore, it is necessary to position the center of gravity by appropriately choosing the shape of the orbiting scroll base. When the above equation is satisfied, excellent orbiting motion can be obtained with the moment components applied to the right bearing 11 are eliminated. The same result can be obtained as regards the left bearing 13.

The center of gravity of the orbiting scroll 4 is positioned on the center line of the eccentric driving shaft 5b, if the shape of the orbiting scroll base 4b is appropriately designed. It is possible to provide a left balance weight 16 on the orbiting scroll 4 at the left side thereof and a right balance weight 17 at the right side thereof, each fixed to the eccentric driving shaft 5b. These balance weights 16 and 17 eliminate moment component generated on the bearings 11 and 13 when the shaft 5b rotates. As a result, a smooth orbit motion of the scroll 4 can be insured even when the shaft is driven at a high speed.

The relationship between the shape of the orbiting scroll base 4b and the center of gravity thereof will now be explained in detail with referring to FIGS. 4 and 5.

Figure 5:
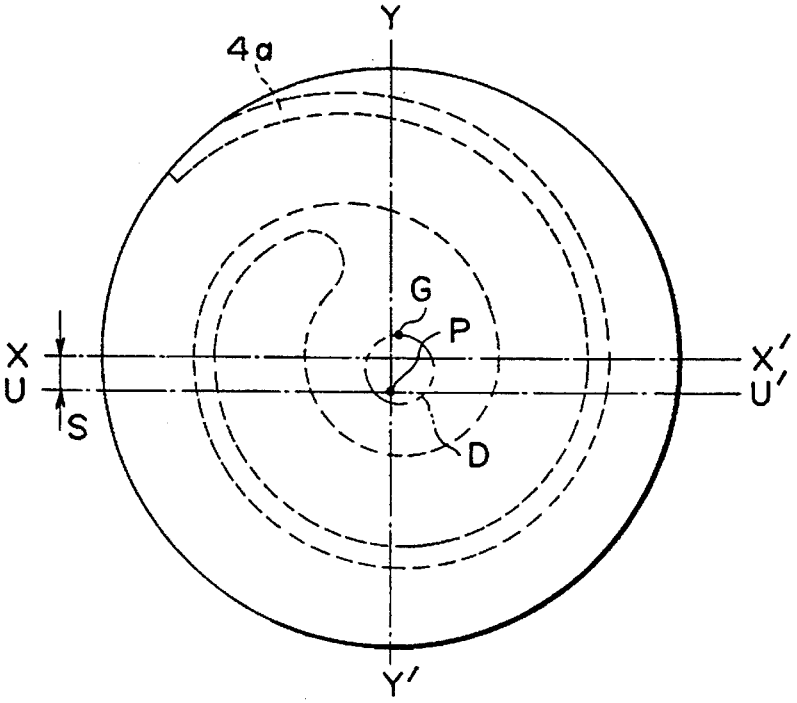
FIG. 5 is a diagram for showing the shape of an scroll base and explaining the positions of the center of gravity.
Figure 6:
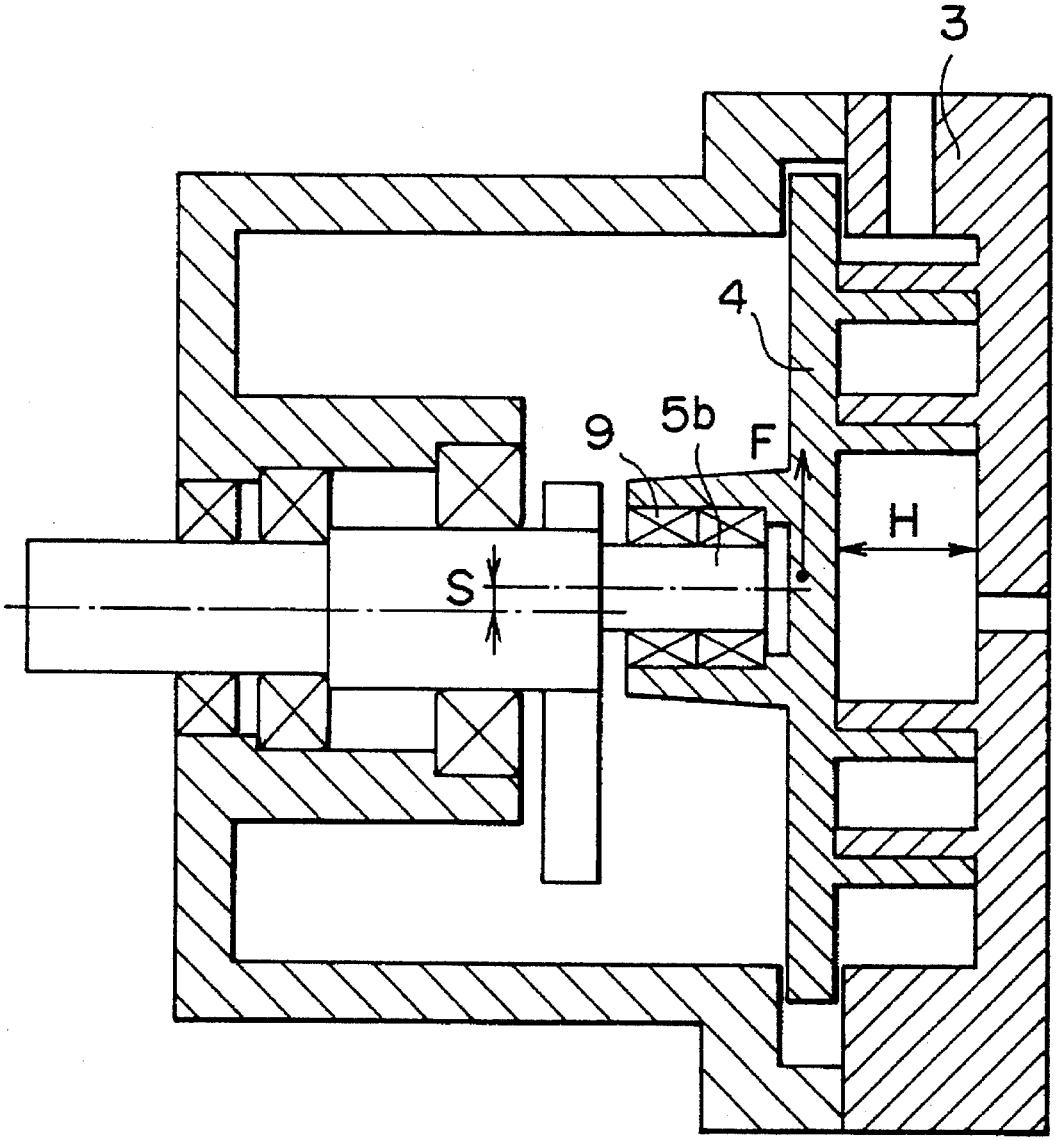
FIG. 6 PRIOR ART
FIG. 6 is a partial vertical cross-sectional view of a conventional fluid machine with scrolls.

FIG. 5 shows the positions of the center of gravity when the shape of the orbiting scroll base is prepared without the relationship with the center of gravity taken into consideration. The driving shaft revolves on its center P, and the orbiting scroll does not revolve on the shaft. A point G as the center of gravity follows the locus of a circle D with a radius of eccentricity S.

The orbiting scroll, of which swirl 4a is asymmetrically prepared, comes to have the point G of the center of gravity out of the circle D. Therefore, the distance from the driving shaft center P to the point G is undetermined. Thus, the centrifugal force F of the orbiting scroll is also undetermined.

Figure 4:
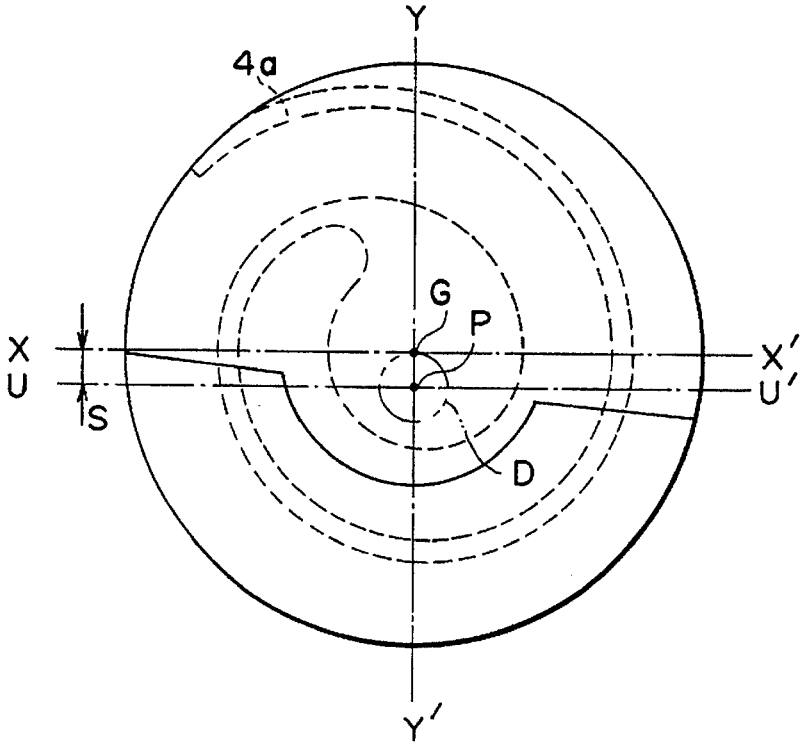
FIG. 4 is a diagram for showing the shape of an scroll base and explaining the positions of the center of gravity.

In FIG. 4, the shape of the scroll base is determined with the provision of a sector-shaped part which is prepared so as to be wider than the other scroll base part toward the back side of the base with respect to the swirl thereof, for the application of a predetermined amount of weight to the scroll to make up for the shift of the center of gravity, and the center of the circle D corresponds to the driving shaft center P. In this case, the distance from the driving shaft center P to the point G as the center of gravity can be made corresponding to the eccentricity S. Consequently, the centrifugal force F generated on the driving shaft can be uniformly maintained.

It is preferable that a left and right balance weights, each with a predetermined size, be provided on the left and right side of the orbiting scroll with the shape of scroll base determined as mentioned above, by which the dynamic balance of the scroll can be kept.

In the fluid machine with scrolls of the present invention, the driving shaft is supported by frame by way of the bearing on one side, and the eccentric driving shaft is supported by the side cover by means of the bearing shoe with the bearing on the other side, so that the radial load applied to the scrolls can be received by the bearings provided on the both sides, as explained above. Accordingly, the conventional problem caused by the support by single side bearing of narrow scroll width can be eliminated, and the scroll width can be increased.

In addition to the above, a stable performance can be attained, because of the wave washers inserted at the sides of bearings with regulating and maintaining the space between the orbiting scroll and the fixed scroll in the thrust direction thereof, thereby obtaining an oil-free type fluid machine with scrolls with an improved discharge.

In other words, it is easy to increase the scroll width and the eccentricity of the shaft since the fluid machine of the present invention keeps dynamic balance of itself. Furthermore, the bearings can be employed for an extended period of time since load is uniformly applied thereto in the present invention.

What is claimed is:

1. An oil-free type fluid machine with scrolls comprising:

a casing, a fixed scroll comprising a fixed scroll base, a fixed scroll swirl extending from said fixed scroll base, an orbiting scroll comprising an orbiting scroll base, an orbiting scroll swirl and an orbiting scroll boss extending from said orbiting scroll base, said fixed scroll and said orbiting scroll interposed one another, a driving shaft with a point P as a revolution center, an eccentric driving shaft provided on said driving shaft with a predetermined eccentricity S, which penetrates said orbiting scroll boss and said fixed scroll base, said orbiting scroll performs an orbiting motion as opposed to said fixed scroll to form a compression room by said orbiting scroll and said fixed scroll, means for preventing said orbiting scroll from rotating on said driving shaft, a first bearing for supporting said driving shaft, a second bearing for supporting said eccentric driving shaft at an end which is not adjacent to said driving shaft, a bearing shoe concentrically provided with respect to said driving shaft, around said eccentric driving shaft and inside said second bearing for obtaining a bilateral bearing structure, a shim provided on an end face of said first bearing, and a wave washer provided at an end face of said second bearing, said shim and said wave washer provided for appropriately adjusting and maintaining spaces formed by said fixed scroll and said orbiting scroll in the thrust direction.

2. The oil-free type fluid machine with scrolls as claimed in claim 1, wherein each of said orbiting and fixed scrolls has a predetermined width T, with the shape of said orbiting scroll basically outlined with successive first to fifth orbiting scroll arcs, said first orbiting scroll arc traced with an optional radius of E with a point A as the center of said first orbiting scroll arc, which corresponds to the center of said eccentric driving shaft and is an intersection of base lines X–X' and Y–Y', successively followed by said second to fifth orbiting scroll arcs described respectively with center points B, C, B and C and respectively with radiuses $OR_1=E+T/2$, $OR_2=OR_1+S+T$, $OR_3=OR_2+S+T$, and $OR_4=OR_3+S+T$, said point B determined as a point located on said base line X–X' which has a distance of T/2 to the left side of said point A, said point C determined as a point located on said base line X–X' which has a distance of T/2+S to the right side of the point A, said second to fifth orbiting scroll arcs being in the form of half circles, each of which started from a point on said base line X–X' and ends thereon, and with the shape of said fixed scroll basically outlined with successive first to fourth fixed scroll arcs based on base lines U–U' and Y–Y' with an intersection thereof as said point P, said base line U–U' drawn in parallel with said base line X–X' with a distance of S therebetween, said first to fourth fixed scroll arcs traced respectively with center points M, N, M and M, and respectively with radiuses $FR_1=E+T/2$, $FR_2=FR_1+S+T$, $FR_3=FR_2+S+T$, and $FR_4=FR_3+S+T$, said point M determined as a point located on said base line U–U' which has a distance of T/2+S to the right side of the point P, said point N determined as a point located on said base line U–U' which has a distance of T/2 to the left side of said point P, said second to fourth fixed scroll arcs being in the form of half circles, each of which started from a point on said base line U–U' and ends thereon.

3. The oil-free type fluid machine with scrolls as claimed in claim 2, wherein said orbiting scroll base comprises a sector-shaped part which is prepared to be wider than the other part of said orbiting scroll base toward the back thereof with respect to said orbiting swirl, in order to cause the center of the gravity of said orbiting scroll to correspond to said point P.

4. The oil-free type scroll fluid machine with scrolls as claimed in claim 3, further comprising a plurality of balance weights for keeping dynamic balance of said orbiting scroll.

5. The oil-free type fluid machine with scrolls as claimed in claim 1, wherein said orbiting scroll base comprises a sector-shaped part which is prepared to be wider than the other part of said orbiting scroll base toward the back thereof with respect to said orbiting swirl, in order to cause the center of the gravity of said orbiting scroll to correspond to said point P.

6. The oil-free type scroll fluid machine with scrolls as claimed 5, further comprising a plurality of balance weights for keeping dynamic balance of said orbiting scroll.

* * * * *